United States Patent [19]

Michel

[11] 4,316,231

[45] Feb. 16, 1982

[54] PROTECTIVE TRANSFER ASSEMBLY FOR SEMICONDUCTOR DEVICES

[75] Inventor: Thomas J. Michel, Miami, Fla.

[73] Assignee: Santek, Inc., Hollywood, Fla.

[21] Appl. No.: 159,179

[22] Filed: Jun. 13, 1980

[51] Int. Cl.[3] ..... H05F 3/02

[52] U.S. Cl. ..... 361/212; 361/220

[58] Field of Search ..... 361/212, 220

[56] References Cited

U.S. PATENT DOCUMENTS 4,040,120 8/1977 Geadah et al. ..... 361/220

FOREIGN PATENT DOCUMENTS 2547390 5/1977 France ..... 361/212

*Primary Examiner*—J. D. Miller
*Assistant Examiner*—L. C. Schroeder
*Attorney, Agent, or Firm*—Michael Ebert

[57] ABSTRACT

A transfer assembly interposable between a storage tube containing semiconductor devices and a processing station therefor, the assembly effecting a controlled electrostatic discharge of each device taken from the tube to prevent a destructive discharge thereof. The transfer assembly includes an insulating track adapted to receive semiconductor devices from the storage tube, each lead of the device received on the track being engaged by a pair of Kelvin contacts, one of which is connected by a normally-open high impedance relay to an input of a test system for the device, the other being connected to ground through the high-impedance drain and source channel of a field effect transistor. Applied to the gate of the transistor is a ramp voltage causing the channel impedance to diminish at a slew rate producing a gradual and safe bleed of the electrostatic charge carried on the engaged lead. At the conclusion of the discharge cycle, the relay is actuated to connect the lead to the test system.

10 Claims, 4 Drawing Figures

PROTECTIVE TRANSFER ASSEMBLY FOR SEMICONDUCTOR DEVICES

BACKGROUND OF INVENTION

Figure 1:
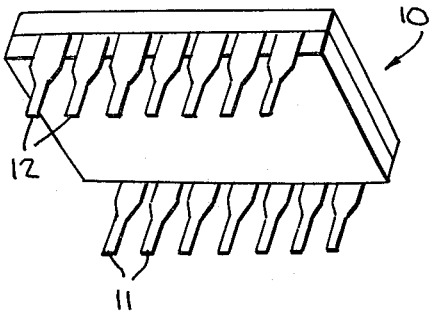

This invention relates generally to the protection of solid-state semiconductor devices from destructive electrostatic discharges, and more particularly to a transfer assembly interposable between a storage tube containing semiconductor devices and a processing station therefor to effect a controlled discharge of each device taken from the tube.

A junction transistor is a bi-polar device whose central base region lies between emitter and collector regions and is separated therefrom by PN junctions. Thus in a junction field effect transistor (J-FET), a bar of one type of semiconductor unipolar material has junctions of opposite types diffused on both sides and interconnected to form the transistor gate. Major categories of junction transistors include grown junctions and allow junctions, as well as diffusion and epitaxal types.

Metal oxide semiconductors (MOS) are semiconductor devices in which an insulating layer critical to the operation of the device is an oxide of the substrate material. For a silicon substrate, the insulating layer is silicon dioxide. Thus a metal oxide semiconductor field effect transistor (MOS-FET) has a gate insulating from its semiconductor substrate by a thin layer of silicon dioxide. Metal oxide semiconductor processes include CMOS, DMOS, NMOS, PMOS and VMOS.

Integrated circuits (IC) made up of MOS transistors can have a higher density of equivalent components than bi-polar or junction transistor integrated circuits. The term "semiconductor device" as used herein is intended to encompass discrete semiconductor components as well as integrated circuits formed thereby.

Electrostatic charges pose a grave threat to the life of semiconductor devices of the junction or MOS type, such as discrete FET's, linear operational IC amplifiers with FET inputs, microprocessors, inverters and comparators. It is well known that when a charge of static electricity that has accumulated in a semiconductor device is discharged across the input circuit thereof or through its sensitive gate, or from a terminal pin to ground, this may cause an internal open or short circuit, thereby effectively destroying the device. Because of their high input impedances, the gates of some FET's, especially MOS types, must be treated very carefully, for they can easily be blown by electrostatic discharges or even by slight currents from an ungrounded soldering iron.

Various techniques have heretofore been employed to cope with the problem of electrostatic discharges in semiconductor devices. One approach in widespread use employs grounding stations for personnel handling the devices. At these stations, "Velostat" wrist straps or conductive materials are coupled to the operator and to his work area, use also being made of conductive mats. In this way, the operator, the conductive mat, the work bench and all other surfaces at the station are connected to ground through resistance paths having ohmic values lying in the range of about 100,000 ohms to one megohm. These paths act effectively as short circuits to static electricity.

The grounding station technique for protecting semiconductor devices from destructive discharges has a number of practical drawbacks. Because a human body can develop as much as 50,000 picofarads of capacitance, a highly-charged semiconductive device coming out of a plastic storage tube can often discharge enough energy to an ungrounded or improperly grounded operator to permanently damage the device. Moreover, human operators create electrostatic discharge paths which differ from person to person, depending on sex, hair characteristics, clothing properties and body chemistry. And when an operator works in an environment having a fluctuating humidity, this, too, influences the effectiveness of ground stabilization. Finally, there is the not uncommon situation where the operator neglects to attach himself to "Velostat" wrist straps. All of these factors adversely affect the reliability of this traditional approach to static protection.

Another technique heretofore employed for static protection of semiconductor devices involves shipping the device in "anti-stat" plastic carrier tubes or storage bags designed to eliminate static charges. This approach is based on the action of a Faraday shield serving as a barrier between the device and static electricity present in the atmosphere. The plastic carrier tube prevents electrostatic charges from reaching the leads of the semiconductor devices.

The anti-static storage tube approach suffers from certain practical disadvantages. First, because the devices in the "anti-stat" tubes are generally in loose form, in the course of transit the devices may be shaken up, thereby generating triboelectric charges. Second, since it becomes necessary at some point to remove the devices from their protective tubes and place them into a mechanical autohandler or auto inserter either for testing or automatic insertion in printed circuit boards, electrostatic protection is lost at this crucial point. And when the devices are taken from their shielded tube to be handled by an operator, one again exposes the devices to deleterious charges in an uncontrolled environment.

Autohandler problems deserve special consideration. Typical of such handlers is the "IC Test Handler with Digital IC Tester," marketed by Daymarc Corporation of Waltham, Mass. In such handlers, magazines are plugged into feed mechanisms which are almost invariably made out of metal and therefore are usually at ground potential. In this situation, one has no control over the electrostatic environment presented by the autohandler. If a particular semiconductor device has acquired a substantial electrostatic charge in the course of transit, when it enters the handler it is abruptly discharged thereby, as a consequence of which sensitive gates in the semiconductor device may be blown up.

Still another technique heretofore employed to prevent destructive electrostatic discharges in semiconductor devices makes use of ion generators. These ionize the air in the work area, the ionized air being circulated to render the atmosphere around the semiconductors more conductive. This approach is intended to raise the leakage rate of static charges from the semiconductors to ground, thereby discouraging the build-up of such charges on the package surfaces of the semiconductor devices and inhibiting controlled destructive discharges.

Two practical difficulties are encountered in this ionization technique which ordinarily employs a nuclear source or a corona generator. In the case of a nuclear source, in order to create a localized atmosphere having a concentration of ions at a level sufficient to render the atmosphere conductive, one requires a powerful nuclear flux of beta or alpha particles. But radiation densities at levels sufficient to provide acceptable leakage paths for the electrostatically-charged semiconductors may represent unacceptable and hazardous levels of radiation to operators working in the same environment.

If, on the other hand, one uses a high-voltage corona generator to ionize the atmosphere, the resultant corona discharges may at the same time impart electrostatic charges to the semiconductor devices, particularly when the resistivities of the packages of the devices and the resistance of the air are in proper balance.

The present invention recognizes that to solve the problem of destructive static discharge, one must focus on the transfer region wherein semiconductor devices coming out of thier storage tubes and carrying electrostatic charges then proceed to make contact with personnel at a work station or enter a manual or autohandler where they make contact with rails and terminals. As explained previously, if personnel make contact with the devices, the uncontrolled capacitance of human operators coupled with the effects of electrostatic phenomena associated with clothing fibers and prevailing atmospheric conditions may be conducive to an electrical discharge of sufficient intensity to destroy the semiconductor. This may occur even when the discharge is not actually felt by the person handling the device.

If, on the other hand, the device from its storage tube is transferred to the rail or track of a typical autohandler connected to a test computer, then a different situation exists. Let us assume, for example, that the semiconductor device is an integrated circuit in a standard dual-in-line (DIP) package whose leads are engaged by Kelvin contacts mounted on the track receiving the device.

These Kelvin contacts on the track are connected to the pin electronics of a computer-controlled IC test system to determine the condition of the integrated circuit before it exits from the autohandler and is put to use. Since the pin electronics are generally fairly low-impedance bipolar transistors, the moment the Kelvin contacts are clamped onto the leads of the IC device, the device sees a very low impedance path to ground. This acts to abruptly discharge whatever static charge is carried by the device, with possibly damaging effects thereon. In some cases, this discharge may also destroy the associated bipolar transistors in the test computer.

The need exists to provide means preventing destructive electrostatic discharges from taking place in the course of the transfer of a semiconductor device from its storage tube to a processing station, whether this station takes the form of a mechanical handler or inserter, or personnel who physically handle the device.

SUMMARY OF INVENTION

In view of the foregoing, the main object of this invention is to provide a transfer assembly interposable between a storage tube or magazine containing semiconductor devices and a processing station therefor, the assembly effecting a controlled discharge of each device taken from the tube.

More particularly, it is an object of this invention to provide a transfer assembly of the above-noted type which acts to electrically isolate the leads of the semiconductor device from the inputs of an associated test system, the so isolated leads being connected to ground through a high impedance channel whose impedance is then reduced at a controlled rate to safely bleed off the electrostatic charge carried by the device.

A significant feature of an assembly in accordance with the invention is that it is possible, upon completion of its static discharge cycle, to then connect the leads of the device to the input of the associated test system without any danger of impairing either the device or the test system.

Also an object of the invention is to provide a transfer assembly which can be embodied in the form of a plug-in retrofit for existing types of autohandler or auto-inserters for semiconductor devices.

Yet another object of the invention is to provide a transfer assembly which is of simple and inexpensive design and which operates reliably and efficiently.

Briefly stated, these objects are accomplished in a transfer assembly in accordance with the invention which includes an insulating track adapted to receive semiconductor devices from a storage tube, each lead of the device received by the track being engaged by a pair of Kelvin contacts, one of which is connected by a normally-open high impedance relay to an input of a test system for the device, the other being connected to ground through the high-impedance drain-source channel of a field effect transistor.

Applied to the gate of the transistor is a ramp voltage causing the transistor impedance to diminish at a controlled slew rate and resulting in a gradual and safe bleed-off of the electrostatic charge carried on the engaged lead. At the conclusion of this discharge cycle, the relay is actuated to connect the engaged lead to the input of the test system, whereby the device can then be subjected to test procedures without endangering either the device or the test system, the device exiting from the assembly in the discharge state upon completion of the tests.

OUTLINE OF DRAWINGS

Figure 2:
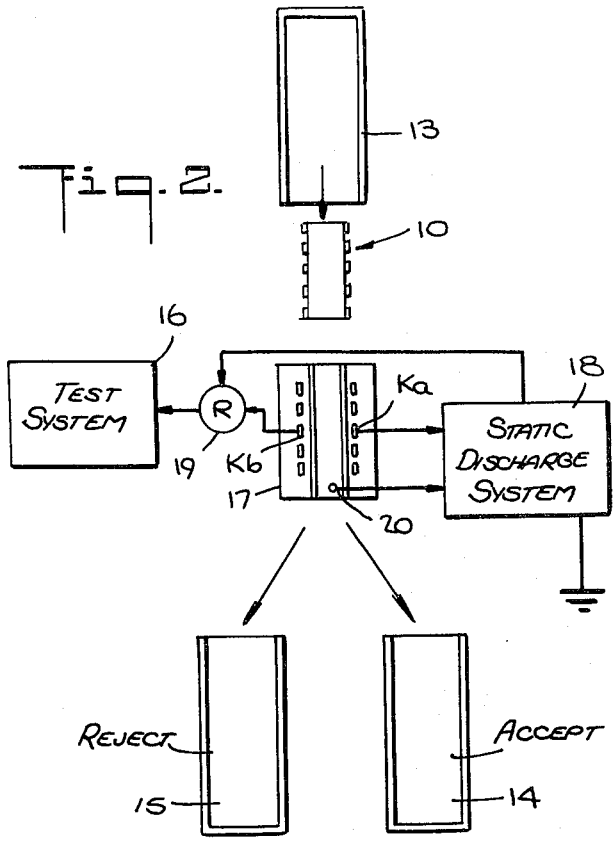
Figure 3:
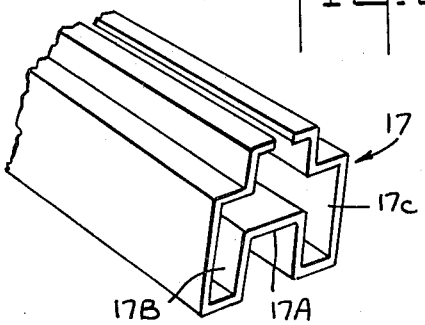
Figure 4:
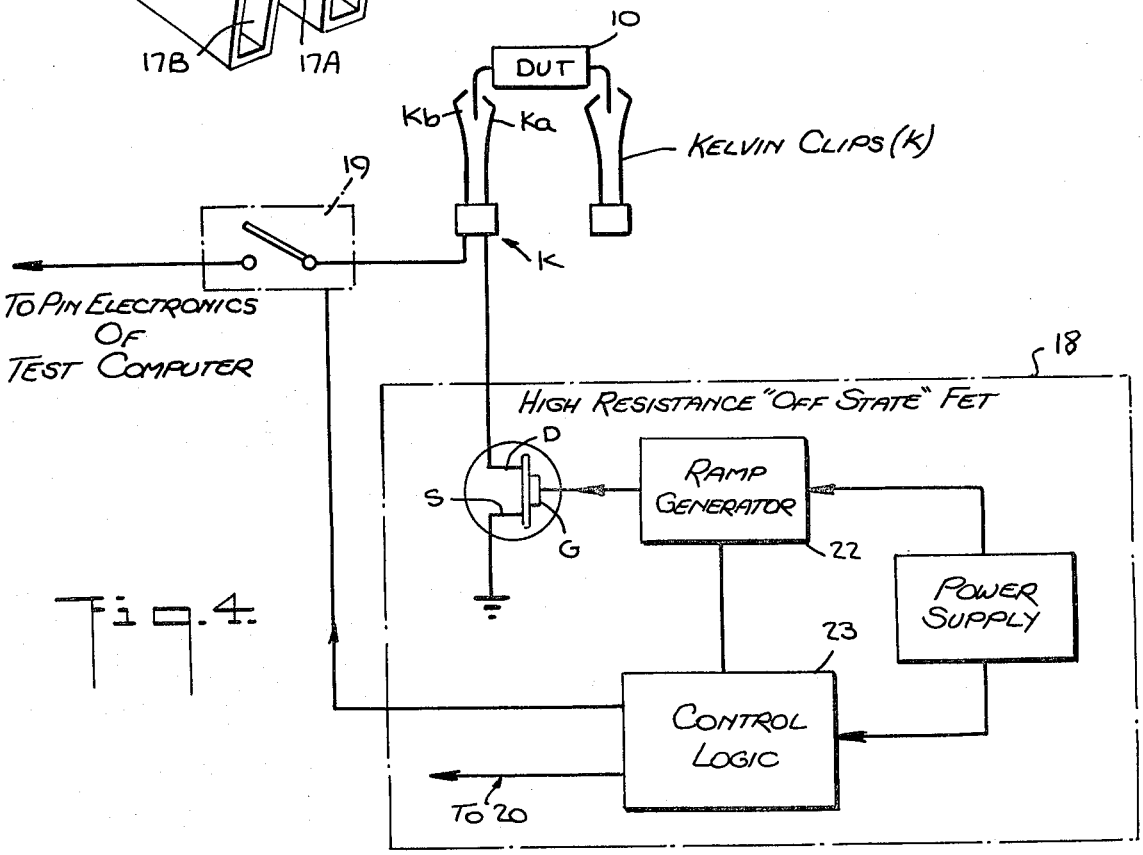

For a better understanding of the invention as well as other objects and further features thereof, reference is made to the following detailed description to be read in conjunction with the accompanying drawings, wherein:

FIG. 1 shows a typical semiconductor device of the dual-in-line type;

FIG. 2 schematically shows a transfer assembly in accordance with the invention, the assembly being incorporated in a manual handler for the semiconductor device;

FIG. 3 illustrates, in perspective, the track for the device being handled; and FIG. 4 is a block diagram of the assembly.

DESCRIPTION OF INVENTION

For the purpose of illustrating a transfer assembly in accordance with the invention which provides a controlled static discharge for semiconductor devices, by way of example we shall assume that the device to be protected is an integrated circuit. As shown in FIG. 1, this integrated circuit is a dual-in-line (DIP) package 10 having two rows 11 and 12 of sidebrazed metal leads on a ceramic base. It is to be understood, however, that the invention is applicable to any semiconductor device having leads engageable by contacts.

We shall further assume that the semiconductor devices are stored and shipped in protective carrier tubes or magazines, as represented by tube 13 in FIG. 2. This tube is associated with a standard manual DIP handler modified to include the protective assembly. The manual handler may be an EMS-202 Manual DIP Handler manufactured by Electro-Mechanical Systems, Inc. of St. Paul, Minn. and described in their published "Instruction Manual."

The EMS-202 handler is a mechanically-operated handler for feeding, contacting and sorting DIP devices under test. The handler accepts gravity fed DIP devices from a storage tube, such as tube 13, in FIG. 2, and closes contact of each lead of the devices in a test area. At the completion of the test interval, the operator decides on the sort grade, and then presses either a green colored sort lever for "accept" or a red colored sort lever for "reject." This lever action directs the tested device to the proper storage tube and introduces another device into the test area. Thus, after testing, the devices are directed either into an "accept" storage tube 14 or a "reject" storage tube 15, depending on the outcome of the test conducted by an computer-controlled IC tester 16 associated with the handler.

The problem with a handler of this commercial type is that when a semiconductor device is admitted into the handler and its leads are engaged by test contacts, if the device carries a substantial electrostatic charge, it will be abruptly discharged with a resultant destruction of the device and possible damage to the associated test unit. Hence a device entering the handler in good condition may leave in a defective state.

In order, therefore, to provide a controlled static discharge to prevent destructive effects, the track 17 which receives the incoming device is formed of a material having a very high insulation resistance. This track, which may have the configuration shown in FIG. 3 includes a gravity slide 17A for the DIP device and a pair of side channels 17B and 17C for accommodating the leads thereof. To this end, the track may be fabricated with a hard aluminum anodic conversion whose aluminum oxide structure electrically resembles ceramic and has a volume resistivity of $5\times10^{16}$ ohms.

Alternatively, the insulation track may be made of less expensive plastic material whose surface resistivity is as high as the packaging material used in the semiconductor device being handled by the assembly. Packaging materials for integrated circuits are usually epoxy compounds having a volume resistivity of about $3\times10^{13}$ ohms. In practice, therefore, a machined or injection molded plastic track for use in the assembly may be fabricated of an epoxy compound, polycarbonate, polypropylene or acrylic material having acceptable insulating properties to provide a high impedance environment for the device which isolates it from ground.

The DIP device received on track 17 has its leads engaged by Kelvin clips, each constituted by a pair of contacts. One of the contacts in the Kelvin clip, as represented by contact $K_a$ in FIG. 2, is connected to a controlled static discharge system 18, shown in greater detail in FIG. 4; while the other contact of the clip, as represented by contact $K_b$, is connected through a normally-open high impedance electromagnetic relay 19 to an input of the test system 16, the relay being preferably hermetically sealed.

The position of the device under test within track 17 is sensed by a suitable mechanical or electro-optical detector 20. When the device occupies its proper test position, detector 20 sends a signal to static discharge system 18 to initiate the static discharge cycle, in the course of which charges on the leads of the DIP device are safely bled off to ground at a controlled rate.

Upon completion of the discharge cycle, the static discharge system sends an activating signal to relay 19, thereby connecting the leads of the device through contacts $K_b$ to the inputs or pin electronics of the test system 16. The test system carries out test procedures appropriate to the device under test and then provides an indication of whether the device is to be accepted or rejected. Computer-controlled test systems of the type appropriate to integrated circuits are disclosed in Section 8-108 et seq. of the "Electronics Engineers' Handbook" of Donald G. Fink—1st Edition—1975—McGraw-Hill Book Co.

Referring now to FIG. 4 showing the details of the static discharge system 18, it will be seen that contact $K_a$ of Kelvin clip K is connected through the drain D-source S channel of a field effect transistor 21 to ground. The input impedance of a field effect transistor is extremely high, its characteristic curves resembling that of a pentode vacuum tube. An important feature of FET's not found in other transistors is that the source-to-drain channel is pure resistance without a diode effect, permitting the FET to act as an electrically-controlled resistor whose resistance is varied by a voltage applied to gate G of the device.

FET 21 is normally cut off; but when a ramp voltage is applied thereto by a ramp generator 22, the high impedance presented by the drain-source channel is reduced at a rate determined by the slew rate of the ramp generator to bleed off to ground the static charge carried by the engaged lead of the semiconductor device 10.

Ramp generator 22 is activated by control logic 23, the ramp generator and logic being energized by a power supply 24. Control logic 23 initiates the static discharge cycle upon receipt of a signal from detector 20 indicating that the device under test is in its proper position in track 17. Upon completion of the discharge cycle, the FET impedance is again returned to its "off" high impedance state and control logic then applies an activating signal to relay 19 which then closes to connect contact $K_b$ to an input of test system 16. Obviously, the number of contacts and associated discharge circuits depends on the number of leads in the semiconductor device being handled by the transfer assembly.

The "off" state impedance of the FET is about $1\times10^{13}$. This impedance under the control of the ramp voltage applied to the gate falls to about 500 ohms at a slew rate causing the drop to occur preferably in about 500 milliseconds. The slew rate can be varied to satisfy the particular characteristics of the device being handled by the transfer assembly. Thus it is possible to discharge J-FET semiconductor devices at a faster rate than MOS-FET's; for the gate contact structure of the former is much less susceptible to burnthrough or punch-out than the very fragile metal-glass capacitor incorporated in the latter.

It is to be understood that where the assembly is to be used in a machine serving to feed semiconductor devices from a storage tube to a pick-up station where the devices are manually inserted in a printed circuit board or tester, there is no need in this arrangement to have the assembly carry out an operation other than a static discharge cycle; for the operator in this situation need only remove the discharged devices from the unit.

Where, however, the assembly is to be incorporated into a commercial autohandler or auto-inserter, such as a Tanaka or Delta autohandler associated with a computer-controlled test system or test board, then the assembly can be made in the form of a plug-in retrofit unit for the autohandler.

While there has been shown and described a preferred embodiment of a protective transfer assembly for semiconductor devices in accordance with the invention, it will be appreciated that many changes and modifications may be made therein without, however, departing from the essential spirit thereof.

I claim:

1. A transfer assembly interposable between a storage tube containing semiconductor devices having leads extended therefrom and a processing station therefor to effect a controlled static discharge of each device taken from the tube to prevent a destructive discharge, said assembly comprising:

A. an insulating track for receiving semiconductor devices from the storage tube;

B. a set of contacts mounted on the track to engage the leads of each device received thereby; and C. a static discharge system having a field effect transistor whose high-impedance drain-source channel is connected between a respective track contact and ground, and means to apply to the gate of the transistor a ramp voltage at a predetermined slew rate, causing the impedance of said channel to go from its normally high value to a low value to provide a controlled discharge path for any static charge carried by the engaged lead.

2. An assembly as set forth in claim 1, wherein said track is fabricated of anodized aluminum having high resistivity.

3. An assembly as set forth in claim 1, wherein said track is fabricated of a plastic material whose resistivity is as high as the resistivity of the material packaging the semiconductor device.

4. An assembly as set forth in claim 1, wherein the set of contacts are contained on Kelvin clips having a second set of contacts also engaging said leads, each of said second set of contacts being connected through a normally-open high impedance relay to an input of a test system for the device, and means to activate the relay upon the completion of the discharge cycle.

5. An assembly as set forth in claim 4, wherein said ramp voltage is supplied by a ramp generator having an adjustable slew rate.

6. An assembly as set forth in claim 5, further including a detector to sense the position of the device in the track and to generate a signal when the device is engaged by said contacts, said signal serving to initiate the operation of said ramp generator.

7. An assembly as set forth in claim 6, wherein said ramp generator is governed by control logic responsive to said signal.

8. An assembly as set forth in claim 7, wherein said logic yields a control signal at the conclusion of the discharge cycle to activate said relay.

9. An assembly as set forth in claim 8, wherein said detector is an electro-optical device.

10. An assembly as set forth in claim 1, wherein said devices are in dual-inline package form.

* * * * *